US009302503B2

(12) United States Patent
Sasaki et al.

(10) Patent No.: US 9,302,503 B2
(45) Date of Patent: Apr. 5, 2016

(54) RECORDING APPARATUS

(71) Applicant: SEIKO EPSON CORPORATION, Tokyo (JP)

(72) Inventors: Tsuneyuki Sasaki, Matsumoto (JP); Eiji Kumai, Matsumoto (JP); Yasuo Naramatsu, Matsumoto (JP); Masahiro Akamine, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/202,933

(22) Filed: Mar. 10, 2014

(65) Prior Publication Data

US 2014/0285602 A1 Sep. 25, 2014

(30) Foreign Application Priority Data

Mar. 19, 2013 (JP) ..... 2013-056185

(51) Int. Cl.

| | |
|---|---|
| ***B41J 2/01*** | (2006.01) |
| ***B41J 11/00*** | (2006.01) |
| *D06F 58/00* | (2006.01) |
| *F26B 11/02* | (2006.01) |
| *F26B 3/00* | (2006.01) |

(52) U.S. Cl.

CPC ..... *B41J 11/002* (2013.01); *B41J 11/007* (2013.01)

(58) Field of Classification Search

CPC .. B41J 11/0015; B41J 11/002; B41M 7/0072; B41M 7/0081; B41M 7/009; D21F 5/02; D21F 5/021; D21F 5/185; F26B 5/16; F26B 13/16; F26B 13/26; F26B 13/101; F26B 13/103; G03D 15/025; G03D 15/027

USPC ..... 347/101–102; 34/111, 116, 123, 335, 34/355

See application file for complete search history.

(56) References Cited

U.S. PATENT DOCUMENTS

| | | | | |
|---|---|---|---|---|
| 4,469,026 | A * | 9/1984 | Irwin | 101/484 |
| 5,349,905 | A * | 9/1994 | Taylor et al. | 101/488 |
| 5,992,994 | A * | 11/1999 | Rasmussen et al. | 347/104 |
| 6,350,009 | B1 * | 2/2002 | Freund et al. | 347/35 |
| 6,536,894 | B1 * | 3/2003 | Rasmussen et al. | 347/104 |
| 6,752,553 | B2 * | 6/2004 | Fujioka | 400/642 |
| 7,845,790 | B2 * | 12/2010 | Baker et al. | 347/104 |
| 2006/0132575 | A1 * | 6/2006 | Fukuda | 347/104 |

(Continued)

FOREIGN PATENT DOCUMENTS

| | | |
|---|---|---|
| JP | 2003-205658 | 7/2003 |
| JP | 2010-280828 | 12/2010 |

(Continued)

*Primary Examiner* — Jannelle M Lebron
*Assistant Examiner* — Jeremy Bishop
(74) *Attorney, Agent, or Firm* — Workman Nydegger

(57) ABSTRACT

A recording apparatus includes a recording head which discharges ink onto a recording medium; a heater which dries the ink discharged on the recording medium by the recording head without making contact with the recording medium; and a transport belt which supports the recording medium in a transportable manner in a position in which it is at least possible to dry a portion of the recording medium on which the ink is discharged using the heater. The transport belt includes a plurality of protruding portions, which can make contact with the recording medium, and a contact area between a contact portion of the protruding portion in relation to the recording medium, and the recording medium is 0.3 $mm^2$ or less.

12 Claims, 2 Drawing Sheets

(56) References Cited

U.S. PATENT DOCUMENTS

| | | | | |
|---|---|---|---|---|
| 2011/0129241 | A1* | 6/2011 | Tomioka et al. | 399/36 |
| 2012/0075394 | A1 | 3/2012 | Ohnishi | |

FOREIGN PATENT DOCUMENTS

| | | |
|---|---|---|
| JP | 2011-016240 | 1/2011 |
| JP | 2012-139857 | 7/2012 |

* cited by examiner

RECORDING APPARATUS

BACKGROUND

1. Technical Field

The present invention relates to a recording apparatus provided with a heater which dries ink that is recorded on a recording medium.

2. Related Art

Recording apparatuses provided with a heater which dries ink that is recorded on a recording medium are used in the related art. Among the recording apparatuses, in regard to an ink jet recording apparatus, which performs recording by discharging ink onto a recording medium, a recording apparatus is generally used which is provided with a heater which dries a portion, on which the ink is recorded, of a recording medium without making contact therewith in order to dry the ink recorded on the recording medium. This is because, when using a heater, which makes contact with and dries the portion on which the ink is recorded, the image quality of the recorded portion decreases due to the contact between the recorded portion and the heater.

For example, JP-A-2010-280828 discloses a recording apparatus which is capable of drying the ink of a recording medium on which recording is performed by warming the recording medium by heating the recording medium using a heater from the side of a platen, which is a medium supporting portion.

In addition, a recording apparatus provided with a transport belt as the medium supporting portion in the transport mechanism of the recording medium is used. In addition to a recording apparatus provided with a transport belt in a recording region opposing the recording head as the transport mechanism, as disclosed in JP-A-2003-205658, a recording apparatus provided with a transport belt on the downstream side of the recording region in the transport direction of the recording medium as the transport mechanism, as disclosed in JP-A-2011-16240, is also used.

Here, in the recording apparatus disclosed in JP-A-2003-205658, the transport belt is provided with a multitude of needle-shaped protrusions, which secure the recording medium so that the recording medium does not shift. In addition, in the recording apparatus disclosed in JP-A-2003-205658, a medium supporting portion is not provided in a region of the recording medium that opposes the drying unit.

However, in a recording apparatus of the related art that is provided with a heater which dries a portion on which the ink is recorded without making contact, such as the one disclosed in JP-A-2010-280828, there is a case in which the vapor which evaporates from the ink due to the heater condenses on the medium supporting portion and the recording medium is wetted. In particular, in a recording apparatus provided with a heater which dries the ink recorded on the recording medium from a side which opposes the medium supporting portion, there are many cases in which the recording medium is wetted due to the vapor condensing on the medium supporting portion.

Meanwhile, in a recording apparatus with a configuration in which a medium supporting portion is not provided in a region of the recording medium that opposes the drying unit, such as the one disclosed in JP-A-2003-205658, the distance between the recording medium and the drying unit changes with the transportation of the recording medium due to the recording medium not being well supported in the opposing region. Therefore, there is a case in which inconsistencies occur in the drying of the ink, which is recorded on the recording medium, by the drying unit.

In addition, in JP-A-2011-16240, there is no description relating to a heater which dries the portion on which the ink is recorded without making contact, and the problem described above is not recognized.

In other words, in a recording apparatus of the related art, in a recording apparatus provided with a heater which dries the ink, which is recorded on the recording medium by discharging the ink onto the recording medium, at a portion on which the ink is recorded without making contact, there is a case in which the suppression of drying inconsistencies by the heater is not sufficient, and in which the suppression of condensing of vapor, which evaporates from the ink due to the heater, and suppression of adhering of the condensed vapor to the recording medium is not sufficient.

SUMMARY

Therefore, an advantage of some aspects of the invention is to suppress drying inconsistencies by the heater, and to suppress condensing of vapor and adhering of the condensed vapor to the recording medium, which evaporates from the ink due to the heater, in relation to a recording apparatus provided with a heater which dries the ink, which is recorded on the recording medium by discharging the ink onto the recording medium, at a portion on which the ink is recorded without making contact.

According to an aspect of the invention, a recording apparatus includes a recording head which discharges ink onto a recording medium; a heater which dries the ink discharged on the recording medium by the recording head without making contact with the recording medium; and a transport belt which supports the recording medium in a transportable manner in a position in which it is at least possible to dry a portion of the recording medium on which the ink is discharged using the heater, in which the transport belt includes a plurality of protruding portions, which can make contact with the recording medium, and in which a contact area between a contact portion of the protruding portion in relation to the recording medium, and the recording medium is 0.3 $mm^2$ or less.

Here, the meaning of "a plurality of protruding portions, which can make contact with the recording medium" includes a protruding portion in which, when the recording medium is supported by the transport belt, depending on the type or the like of the recording medium, there is a case in which the protruding portion makes contact with the recording medium, and a case in which the protruding portion does not make contact with the recording medium. Therefore, the expression means that it is sufficient for the protruding portion to be able to make contact with the recording medium.

According to this aspect, the contact area of each contact portion of the protruding portion in relation to the recording medium is 0.3 $mm^2$ or less. Therefore, the area of the contact portion is sufficiently small for vapor, which evaporates from the ink recorded on the recording medium, to condense on the contact portion. In other words, it is possible to suppress condensing of vapor on the contact portion and adhering of the condensed vapor to the recording medium by causing the vapor to condense on the non-contact portion in relation to the recording medium and suppressing condensing of the vapor on the contact portion.

In addition, according to this aspect, the transport belt supports the recording medium in a transportable manner in a position in which it is possible to dry at least a portion on which the ink is recorded using the heater. Therefore, it is possible to suppress changing of the distance between the recording medium and the heater with the transportation of the recording medium, and it is possible to suppress the occurrence of inconsistencies in the drying of the ink, which is recorded on the recording medium, by the heater.

At least a portion of the protruding portion may be formed by an elastic member.

According to this aspect, since at least a portion of the protruding portion is formed by an elastic member, it is possible to suppress damage to the recording medium due to the protruding portion piercing the recording medium.

The protruding portion may be a bristle-like body.

According to this aspect, since the protruding portion is a bristle-like body, the contact area of each contact portion can be set to 0.3 $mm^2$ or less with a simple configuration.

The recording apparatus may further include a removal unit which removes a liquid, which is generated due to condensation of vapor that evaporates from the ink due to the heater and is collected in a non-contact portion, which does not make contact with the recording medium, of the transport belt, from the non-contact portion.

According to this aspect, even if the liquid generated by the condensation of the vapor collects in the non-contact portion, it is possible to remove the collected liquid using the removal unit such as a scraper, for example.

The transport belt may be capable of moving passively together with transportation of the recording medium by the transport unit.

According to this aspect, it is possible to transport the recording medium using the driving force or the like of a winding unit, which winds the recording medium on which recording is performed, for example, without separately providing a drive source of the transport belt requiring a great amount of drive energy.

The recording apparatus may further include a locking mechanism which stops movement of the transport belt.

According to this aspect, for example, it is possible to stop the movement of the transport belt when executing the recording onto the recording medium, and to cause the transport belt to move when cleaning the transport belt.

A kinetic friction coefficient between the recording medium and the transport belt in a state in which the transport belt is stopped may be from 0.4 to 0.6.

According to this aspect, the kinetic friction coefficient between the recording medium and the transport belt in a state in which the transport belt is stopped is from 0.4 to 0.6. When the kinetic friction coefficient is less than 0.4, there is a case in which support problems occur due to the recording medium sliding from the transport belt. In addition, when the kinetic friction coefficient is greater than 0.6, there is a case in which support problems occur due to difficulty in the recording medium moving from the transport belt. Therefore, the aspect can suppress the occurrence of such support problems.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
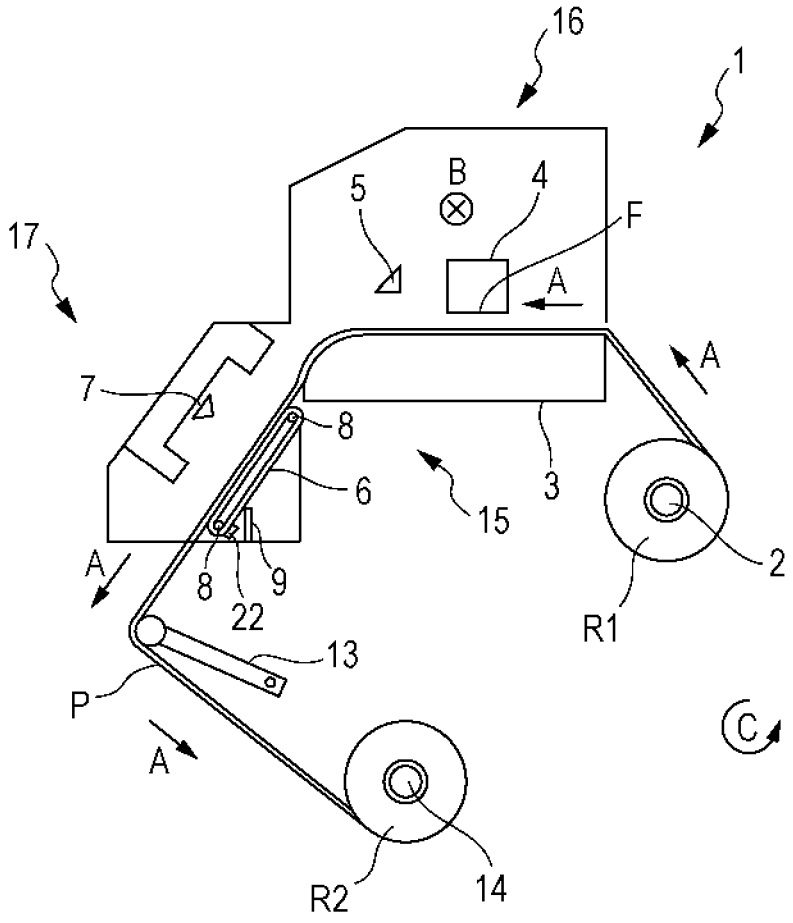
FIG. 1 is a schematic side view which shows a recording apparatus according to example 1 of the invention.
Figure 2:
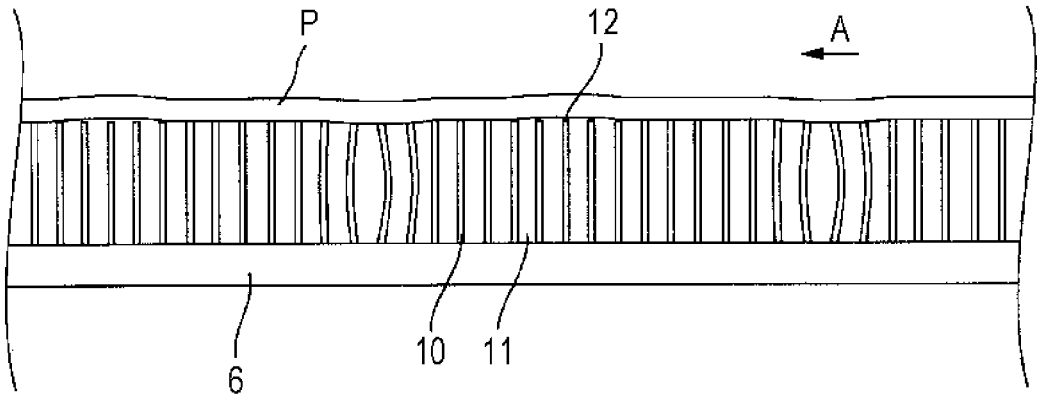
FIG. 2 is a schematic view which shows a transport belt in the recording apparatus according to example 1 of the invention.

Example (FIGS. 1 and 2)

Detailed description will be given below of recording apparatuses according to the examples of the invention with reference to the attached drawings.

First, description will be given of a recording apparatus according to example 1 of the invention. The recording apparatus is a recording apparatus that can perform recording on a recording medium using an aqueous ink. However, the invention is not limited to a recording apparatus that can use an aqueous ink.

FIG. 1 shows a schematic side view of a recording apparatus 1 according to example 1 of the invention.

The recording apparatus 1 of this example is provided with a setting portion 2 of a recording medium P. The setting portion 2 can feed a roll R1 of the recording medium P for performing recording. Furthermore, the recording apparatus 1 of this example uses a roll-type recording medium as the recording medium P. However, the invention is not limited to a recording apparatus that uses such a roll-type recording medium. For example, a cut-sheet type of recording medium may also be used.

In the recording apparatus 1 of this example, when the recording medium P is transported in a transport direction A, the setting portion 2 rotates in a rotation direction C.

In addition, the recording apparatus 1 of this example is provided with a transport mechanism 15, which is provided with a plurality of transport rollers (not shown) for transporting the roll-type recording medium P in the transport direction A.

In addition, the recording apparatus 1 of this example is provided with a recording mechanism 16, which performs recording by causing a recording head 4 to scan the recording medium P reciprocally in a scanning direction B that intersects the transport direction A of the recording medium P. The recording head 4 discharges an ink onto the recording medium P. An image is formed (recorded) on the recording medium P by the ink that is discharged from the recording head 4. Furthermore, the recording apparatus 1 of this example is provided with the recording mechanism 16, which performs recording by causing the recording head 4 to scan the recording medium P reciprocally. However, the recording apparatus 1 may also be a recording apparatus provided with a so-called line head, in which a plurality of nozzles that discharge an ink is provided in a direction intersecting the transport direction A.

A drying mechanism 17 is provided on the downstream side in the transport direction A of the recording medium P of the recording head 4. The drying mechanism 17 includes a heater 7, which dries a portion on which ink is recorded, in which the ink is recorded on the recording medium P by the recording head 4, without making contact. In other words, the heater 7 may be a heater which dries the ink, which is discharged on the recording medium P by the recording head 4, without making contact with the recording medium. Furthermore, the heater 7 of this example is an infrared heater. However, as long as the heater 7 is a heater, which dries a portion on which ink is recorded, in which the ink is recorded on the recording medium P by the recording head 4, without making contact, the type, shape, installation location and the like thereof are not particularly limited.

In addition, the drying mechanism 17 is provided with a transport belt 6, which supports the recording medium P in a transportable manner in a position in which it is possible to dry a portion on which the ink is recorded using the heater 7. In addition, in the recording apparatus 1 of this example, the transport belt 6 moves due to driven rollers 8 and 8 rotating in the rotation direction C together with the transportation of the recording medium P in the transport direction A. However, the invention is not limited to this configuration, and may be provided with a drive mechanism of the transport belt 6.

In addition, the transport belt 6 of this example is provided with a locking mechanism 22, and it is possible to stop the movement of the transport belt 6 when executing the recording onto the recording medium P, and to cause the transport belt 6 to move when cleaning the transport belt 6. Furthermore, in the recording apparatus 1 of this example, in a state in which the transport belt 6 is stopped, the kinetic friction coefficient between the recording medium P, which is assumed to be used, and the transport belt 6 is from 0.4 to 0.6. When the kinetic friction coefficient is less than 0.4, there is a case in which support problems occur due to the recording medium P sliding from the transport belt 6. In addition, when the kinetic friction coefficient is greater than 0.6, there is a case in which support problems occur due to difficulty in the recording medium P moving from the transport belt 6. The recording apparatus 1 of this example is with a configuration capable of suppressing the occurrence of these support problems.

Table 1 below shows the experimental results of a case in which experimentation is carried out by changing the kinetic friction coefficient between the recording medium P and the transport belt 6, where a case in which the transportation properties are favorable (support problems do not occur) is shown as OK, and a case in which support problems occur is shown as NG.

TABLE 1

| Kinetic Friction Coefficient | Transportation Properties |
|---|---|
| 0.1 | NG |
| 0.2 | NG |
| 0.3 | NG |
| 0.4 | OK |
| 0.5 | OK |
| 0.6 | OK |
| 0.7 | NG |
| 0.8 | NG |
| 0.9 | NG |
| 1.0 | NG |

In addition, the recording apparatus 1 of this example is provided with a scraper 9. The scraper 9 functions as the removal unit, which removes a liquid, which is generated due to condensation of vapor that evaporates from the ink, which is recorded to the recording medium P, due to the heater 7 and is collected in a non-contact portion 11 (refer to FIG. 2), which does not make contact with the recording medium P, of the transport belt 6, from the non-contact portion 11.

In addition, the recording head 4 is provided with a nozzle surface F, which includes a plurality of nozzles that discharge ink, and the transport belt 6, which is an endless belt, is disposed inclined so as to separate from a surface that is parallel with the nozzle surface F from the upstream side of the transport direction A toward the downstream side thereof. Therefore, it is possible to transport the recording medium P using the gravitational force received by the recording medium P, and it is possible to suppress the transportation load.

In addition, a tension adjustment unit 13 is provided on the downstream side in the transport direction A of the recording medium P of the drying mechanism 17. The tension adjustment unit 13 serves to adjust the tension of the recording medium P when winding the recording medium P. Furthermore, a winding unit 14, which can wind the recording medium P, is provided on the downstream side in the transport direction A of the recording medium P of the tension adjustment unit 13. The recording apparatus 1 of this example can transport the recording medium P while allowing the transport belt 6 to rotate according to the driving force of the winding unit 14 and the friction force between the transport belt 6 and the recording medium P, or in a state in which the transport belt 6 is stopped.

Furthermore, in the recording apparatus 1 of this example, when the recording medium P is wound, the winding unit 14 rotates in the rotation direction C.

Next, description will be given of the transport belt 6 of this example.

FIG. 2 is a schematic view which shows the transport belt 6 of this example.

The transport belt 6 of this example includes a plurality of protruding portions 10, which can make contact with the recording medium P, and a non-contact portion 11, which does not make contact with the recording medium P. Since at least a portion of the protruding portion 10 of this example is a bristle-like body formed by an elastic member, the configuration is capable of suppressing damage to the recording medium P due to the protruding portion 10 piercing the recording medium P. However, the configuration is not limited thereto. In addition, the contact area of each of the contact portions 12 between the protruding portion 10 and the recording medium P is 0.3 $mm^2$ or less.

Since the contact area of each of the contact portions 12 of this example is 0.3 $mm^2$ or less, the area of the contact portions 12 is sufficiently small for vapor, which evaporates from the ink recorded to the recording medium, to condense on the contact portions 12. In other words, the configuration is capable of suppressing condensing of the vapor on the contact portions 12 and adhering of the condensed vapor to the recording medium P by causing the vapor to condense on the non-contact portion 11 and suppressing condensing of the vapor on the contact portions 12.

Table 2 below shows the experimental results of a case in which experimentation is carried out by changing the contact area of the contact portion 12 in order to determine whether or not vapor, which evaporated from the ink that is recorded to the recording medium P, condenses on the contact portion 12. Specifically, using a fabric as the recording medium P, the contact area between the contact portion 12 and the recording medium P is changed, and it is evaluated whether or not a liquid generated by the condensation of the vapor causes staining to occur on the recording medium P. A case in which the liquid does not cause staining to occur is shown as OK, and a case in which the liquid does cause staining to occur is shown as NG. Furthermore, an epoxy resin is used as the material of the contact portion 12.

TABLE 2

| Contact Area ($mm^2$) | Transportation Properties |
|---|---|
| 2.27 | NG |
| 1.77 | NG |
| 1.13 | NG |
| 0.50 | NG |
| 0.38 | NG |
| 0.28 | OK |
| 0.20 | OK |

Figure 3:
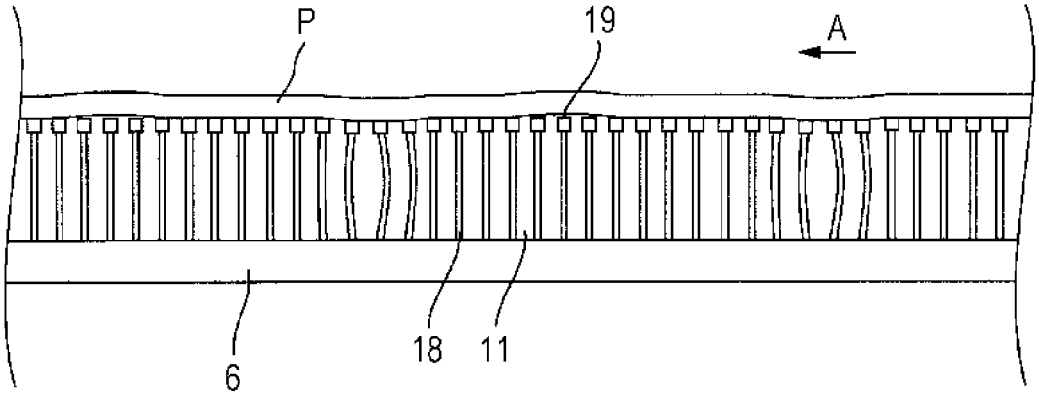
FIG. 3 is a schematic view which shows a transport belt in a recording apparatus according to example 2 of the invention.

Example 2 (FIG. 3)

Next, description will be given of the recording apparatus according to example 2 of the invention.

FIG. 3 is a schematic view which shows the transport belt 6 in the recording apparatus 1 according to example 2 of the invention. Furthermore, components which are common with those of the example described above are represented with the same reference signs and numerals, and detailed description thereof is omitted.

The recording apparatus 1 of this example differs from the recording apparatus 1 of example 1 only in the shape of the protruding portion provided on the transport belt 6. In a protruding portion 18 of this example, each contact portion 19 between the protruding portion 18 and the recording medium P has a contact area within the range of 0.3 $mm^2$ or less. Therefore, the contact portion 19 is wider than the contact portion 12 of the protruding portion 10 of example 1.

Figure 4:
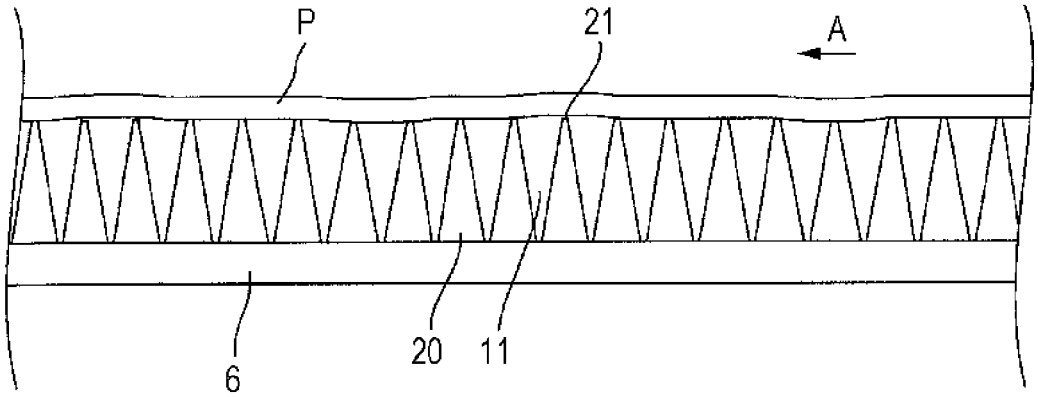
FIG. 4 is a schematic view which shows a transport belt in a recording apparatus according to example 3 of the invention.

Example 3 (FIG. 4)

Next, description will be given of the recording apparatus according to example 3 of the invention.

FIG. 4 is a schematic view which shows the transport belt 6 in the recording apparatus 1 according to example 3 of the invention. Furthermore, components which are common with those of the example described above are represented with the same reference signs and numerals, and detailed description thereof is omitted.

The recording apparatus 1 of this example differs from the recording apparatus 1 of examples 1 and 2 only in the shape of the protruding portion provided on the transport belt 6. Instead of being a bristle-like body, the protruding portion 20 of this example has a cone shape with a contact portion 21, which is planar, provided on the distal end portion thereof. Furthermore, the contact area of each of the contact portions 21 between the protruding portion 20 and the recording medium P is within the range of 0.3 $mm^2$ or less.

Furthermore, the recording apparatuses 1 of examples 1 to 3 are recording apparatuses capable of recording using an aqueous ink, which contains an aqueous organic solvent. In regard to a recording apparatus that uses such an ink, an aqueous organic solvent is contained in the vapor. Therefore, since the aqueous organic solvent does not easily volatilize when the vapor condenses on the transport belt 6, there is a case in which a liquid that is generated by the condensation of the vapor on the transport belt 6 is likely to remain. Therefore, while the invention is particularly valid in a recording apparatus, which can perform recording using an aqueous ink that contains an aqueous organic solvent, the invention is not limited to such a recording apparatus.

In addition, in a transport mechanism 15 that functions as the transport unit, a platen heater 5, which is capable of heating the recording medium P at the platen 3, may also be provided.

Furthermore, the platen heater 5 of this example is an infrared heater provided in a position opposing the platen 3. However, the platen heater 5 is not limited to such a heater, and a heater may also be used which is capable of heating the recording medium P from the platen 3 side.

Furthermore, when the only heater in the recording apparatus is the heater 7, the term "heater" refers to the heater 7. In addition, when the platen heater 5 is provided in addition to the heater 7, the platen heater 5 and the heater 7 are distinguished as a first heater and a second heater, respectively.

The entire disclosure of Japanese Patent Application No. 2013-056185, filed Mar. 19, 2013 is expressly incorporated by reference herein.

What is claimed is:

1. A recording apparatus, comprising:

a recording head which discharges ink onto a front surface of a recording medium;

a heater which dries the ink discharged on the recording medium by the recording head without making contact with the recording medium; and a transport belt which supports a rear surface of the recording medium, a locking mechanism which stops movement of the transport belt, wherein the transport belt includes a plurality of protruding portions, which can make contact with the rear surface of the recording medium at a location in front of the heater, wherein the transport belt is capable of moving passively together with transportation of the recording medium by the transport unit.

2. The recording apparatus according to claim 1, wherein at least a portion of the protruding portion is formed by an elastic member.

3. The recording apparatus according to claim 1, wherein the protruding portion is a bristle-like body.

4. The recording apparatus according to claim 1, further comprising:

a removal unit which removes a liquid, which is generated due to condensation of vapor that evaporates from the ink due to the heater and is collected in a non-contact portion, which does not make contact with the recording medium, of the transport belt, from the non-contact portion.

5. The recording apparatus according to claim 1, wherein a kinetic friction coefficient between the recording medium and the transport belt in a state in which the transport belt is stopped is from 0.4 to 0.6.

6. The recording apparatus according to claim 1, wherein the transport belt is disposed in an inclined manner, at the location in front of the heater.

7. The recording apparatus according to claim 1, further comprising:

a plurality of transport rollers which transports the recording medium.

8. The recording apparatus according to claim 1, further comprising:

a tension adjustment unit which adjusts a tension of the recording medium.

9. A recording apparatus, comprising:

a recording head which discharges ink onto a recording medium;

a heater which dries the ink discharged on the recording medium by the recording head without making contact with the recording medium; and a transport belt which supports the recording medium, a locking mechanism which stops movement of the transport belt, wherein the transport belt includes a plurality of protruding portions which can make contact with the recording medium at a location in front of the heater wherein the transport belt is capable of moving passively together with transportation of the recording medium by the transport unit.

10. The recording apparatus according to claim 9, wherein the transport belt is disposed in an inclined manner, at the location in front of the heater.

11. The recording apparatus according to claim 9, further comprising:

a plurality of transport rollers which transports the recording medium.

12. The recording apparatus according to claim 9, further comprising:

a tension adjustment unit which adjusts a tension of the recording medium.

* * * * *